US006234821B1

(12) United States Patent
Tan

(10) Patent No.: US 6,234,821 B1
(45) Date of Patent: May 22, 2001

(54) CONNECTOR FOR RAM MODULE

(76) Inventor: Ying Wu Tan, 3Fl., No.492, Sec.1 Wan-Shou Rd., Tao-Yuan Hsien (TW)

( * ) Notice: Subject to any disclaimer, the term of this patent is extended or adjusted under 35 U.S.C. 154(b) by 0 days.

(21) Appl. No.: 09/565,410

(22) Filed: May 4, 2000

(51) Int. Cl.[7] ..... H01R 13/62
(52) U.S. Cl. ..... 439/328
(58) Field of Search ..... 439/325, 326, 439/327, 328

(56) References Cited

U.S. PATENT DOCUMENTS 5,938,463 * 8/1999 Yodogawa ..... 439/328
6,030,245 * 2/2000 Choy ..... 439/328

* cited by examiner

*Primary Examiner*—Paula Bradley
*Assistant Examiner*—Tho D. Ta
(74) *Attorney, Agent, or Firm*—Pro-Techtor International Services

(57) ABSTRACT

A connector assembly comprises a plastic connector mounted on mainboard and two metal enhancement devices wherein connector includes a body and two parallel arms each including two spaced raised members, a positioning projection, and a protrusion with a guide slope defined between top side of arm and protrusion; and enhancement devices are secured to arms including a U-shaped plate member having a planar portion and two spaced tab members with central openings, a protruded engagement member fixed on mainboard, and an outward slant flexible strip. With the support of engagement members, strips can share stress with plate members and flexed arms when inserting RAM module in connector, resulting in a uniform stress distribution on the assembly.

17 Claims, 5 Drawing Sheets

CONNECTOR FOR RAM MODULE

FIELD OF THE INVENTION

The present invention relates to connector and more particularly to an improved connector for connecting a RAM module to mainboard of computer.

BACKGROUND OF THE INVENTION

Random access memory (RAM) is one of indispensable components of personal computer (e.g., desktop or notebook computer). The processing speed of computer is related to size of RAMs to a certain degree. RAMs are conventionally manufactured in a rectangular packet called module. Such RAM module is inserted in a connector mounted on mainboard of computer. It is common that a number of such connectors are provided on mainboard. As such, user may insert a desired number of RAM modules in connectors to obtain an optimum memory size. Traditionally, connector is integrally formed with two plastic arms at both ends. With this, a mounted RAM module may not loosen in connector after fastened by arms and connector. It is understood that the arms are flexed outward temporarily when inserting RAM module. As such, arms may be broken or permanently deformed if not sufficient care is taken during that insertion process. If such occurred, connector has to be replaced.

An improved conventional connector arm enhancement mechanism is shown in FIG. 8. As shown, a metal enhancement device (b) is secured to each arm (a). Enhancement device (b) has a rectangular cross section including an extended attachment member (b1) inserted in slot (a1) of arm (a), a pointing up tab (b2) for enclosing arm (a), a protruded engagement member (b)3 adjacent tab (b2) being fixed on mainboard c by soldering, and an inward slant flexible strip (b4) extended from one side of opening for urging against arm (a).

But this is unsatisfactory for the purpose for which the invention is concerned for the following reasons:

1) Enhancement device (b) is stiff due to the rectangular cross section design.

2) Engagement member (b3) is located between end of arm (a) and slot (a1) (i.e., the position susceptible to deformation).

These two factors together will cause arm (a) not easily bent or deformed, resulting in a loss of flexibility. Thus, it is not convenient to install RAM module despite the enhancement of strength of arm (a).

SUMMARY OF THE INVENTION

It is thus an object of the present invention to provide a connector with auxiliary stress reduction mechanism for connecting a RAM module to mainboard of computer. By utilizing this, a breakage or damage to connector as occurred in prior art is eliminated during the RAM module insertion process.

It is another object of the present invention to provide a connector with auxiliary stress reduction mechanism for conveniently connecting a RAM module to mainboard of computer.

To achieve the above and other objects, the present invention provides a connector assembly comprising a plastic connector mounted on mainboard and two metal enhancement devices wherein connector includes a body, two parallel arms each including two spaced raised members, a positioning projection, and a protrusion with a guide slope defined between top side of arm and protrusion, slot, and a plurality of contact electrodes in the slot; and enhancement devices are secured to arms each including a U-shaped plate member having a planar portion and two spaced tab member with central openings, a protruded engagement member fixed on mainboard, and an outward slant flexible strip With the support of engagement members, flexible strips can share the stress with plate members and arms when arms flex outward or inward during the process of installing RAM module. This can prevent stress from concentrating on joints of body and arms of connector. Thus, joints are not susceptible to breakage.

The above and other objects, features and advantages of the present invention will become apparent from the following detailed description taken with the accompanying drawings.

DETAILED DESCRIPTION OF THE PREFERRED EMBODIMENTS

Figure 1:
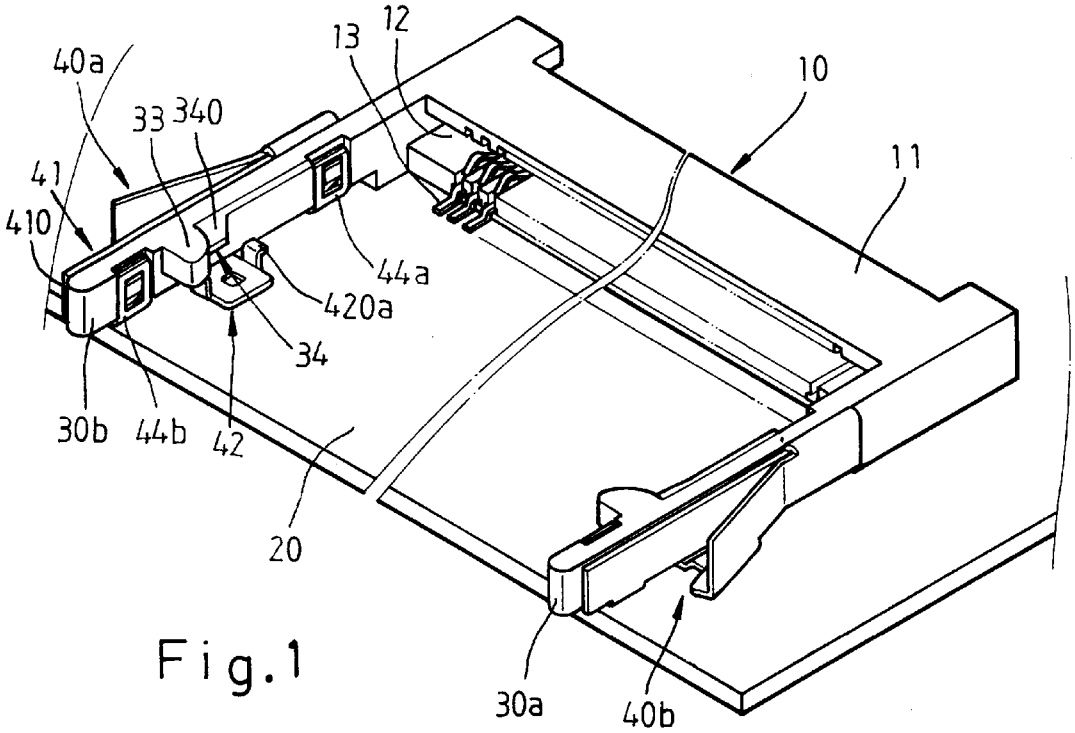
FIG. 1 is a perspective view of of assembled connector and enhancement device according to the invention.

Referring to the accompanying drawings particularly to FIG. 1, there is shown a connector assembly constructed in accordance with the invention comprising a connector 10 made of plastic material mounted on mainboard 20 and a pair of enhancement devices 40*a* and 40*b*. Connector 10 includes a body 11, parallel left arm 30*a* and right arm 30*b* at both ends of body 11, slot 12, and a plurality of contact electrodes 13 in the slot 12. Also, a metal left enhancement device 40*a* and left enhancement device 40*a* are secured to left arm 30*a* and right arm 30*b* respectively. Note that arms 30*a* and 30*b* and enhancement devices 40*a* and 40*b* are bilaterally symmetrical so that description of one side (e.g., right arm 30*b* and left enhancement device 40*a*) serves to describe the entirety.

Figure 2:
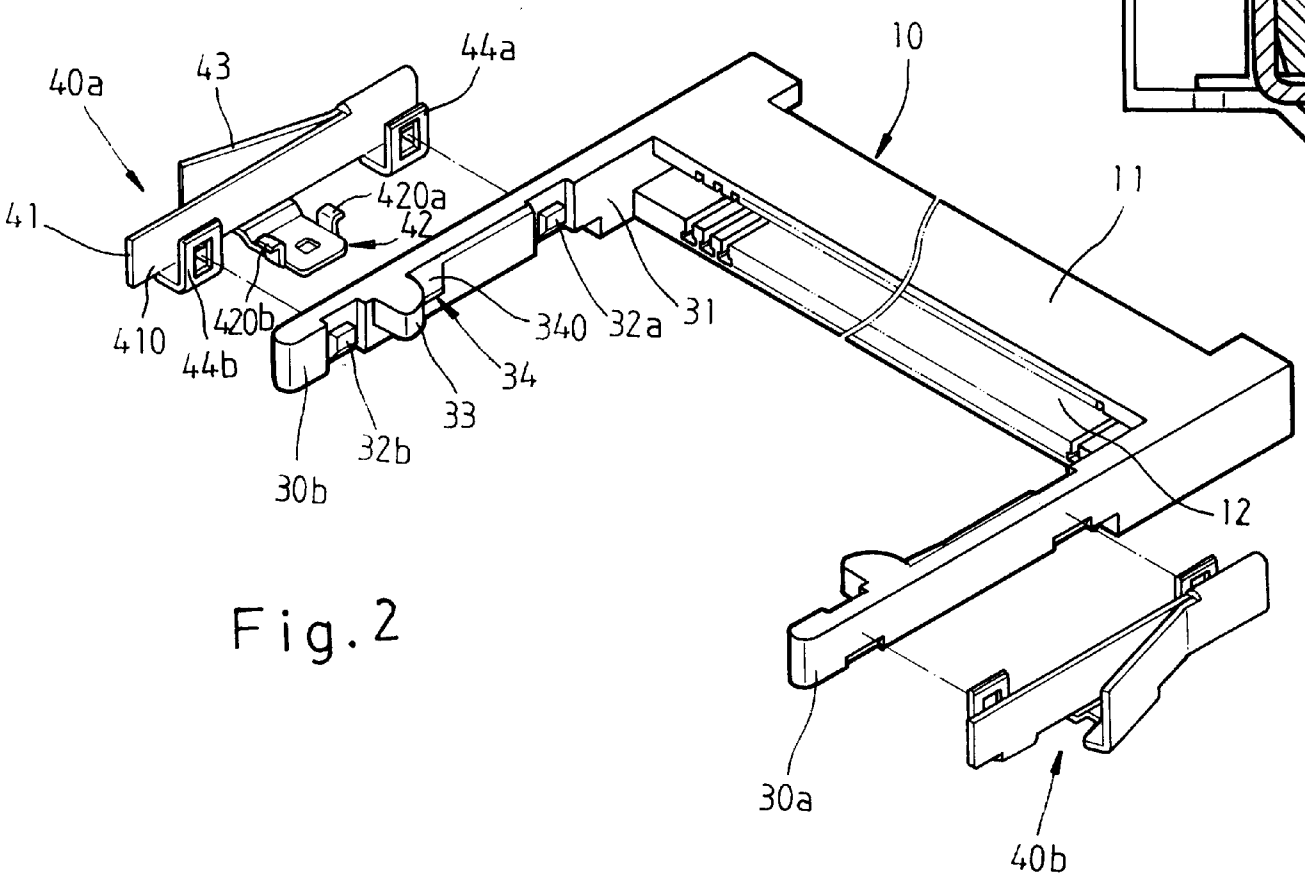
FIG. 2 is an exploded view of FIG. 2.

Referring to FIG. 2 specifically, right arm 30*b* and body 11 are connected in joint 31. Right arm 30*b* includes two spaced raised members 32*a* and 32*b* in the inner side, a positioning projection 33, and a protrusion 34 with a guide slope 340 defined between top side of right arm 30*b* and protrusion 34.

Figure 3A:
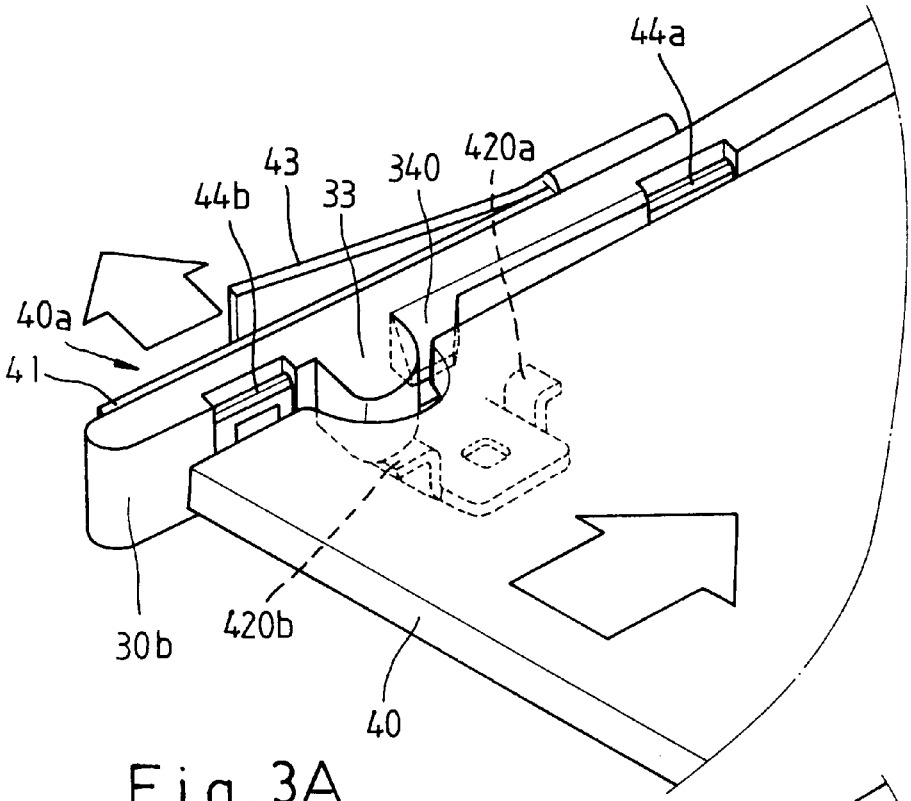
FIG. 3A is a perspective view, RAM module being shown during mounting to connector.
Figure 3B:
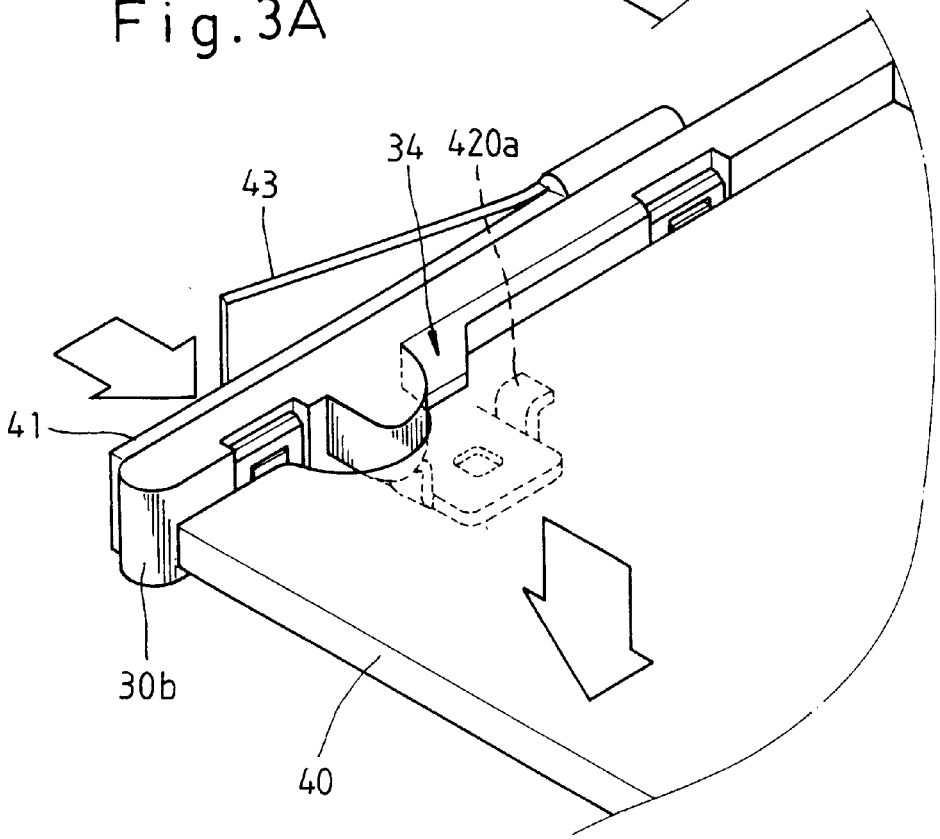
FIG. 3B is similar to FIG. 3A, RAM module being mounted.

Referring to FIGS. 3A and 3B specifically, RAM module 40 is slantingly inserted toward slot 12 (see right arrow in FIG. 3A). This cause guide slope 340 to outward flex a little (see left arrow in FIG. 3A). Then press down RAM module 40 to cause protrusion 34 to engage with the top of RAM module 40 when it firmly inserts in slot 12 (see right arrow in FIG. 3B). Finally, guide slope 340 flexs inward by its elastic returning force to finish installing (see left arrow in FIG. 3B). At this time, positioning projection 33 moves into a side recess to become engaged so as to secure RAM module 40.

Referring to FIG. 2 again, right enhancement device 40*b* includes a plate member 41, a protruded engagement member 42, and an outward slant flexible strip 43. Preferably, plate member 41 has a length conformed to that of right arm 30*b*. Engagement member 42 is fixed on mainboard 20 by soldering. Plate member 41 has a U-shaped cross section including a planar portion 410 and a pair of spaced tab members 44*a* and 44*b* extended from bottom of planar portion 410 to form an L shape. Tab members 44*a* and 44*b* have central openings corresponding to raised members 32*a* and 32*b* respectively. It is appreciated by those skilled in contact electrodes art that above configuration is only an embodiment for engaging tab members 44*a* and 44*b* with raised members 32*a* and 32*b*. Other configurations are possible such as raised members 32*a* and 32*b* provided on the outer side surfaces of arms 30*a* and 30*b*, or tab members 44*a* and 44*b* extended inwardly from top of planar portion 410 to engage with arms 30*a* and 30*b*.

Figure 6:
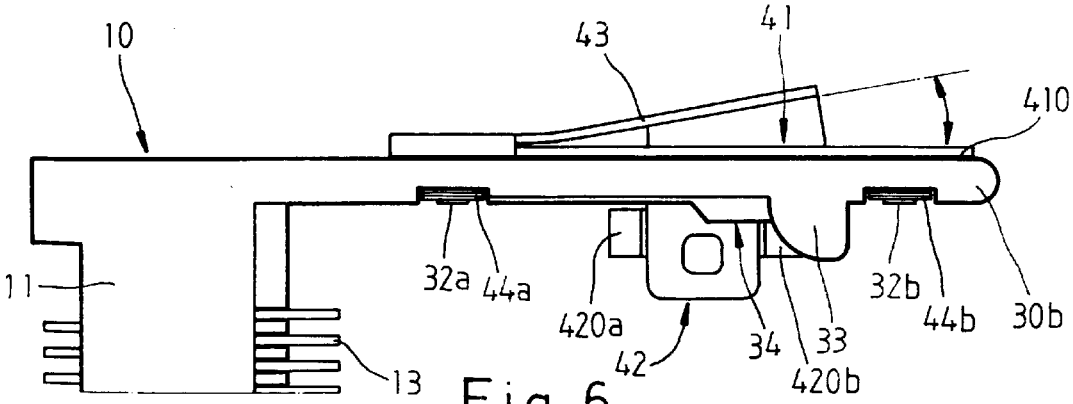
FIG. 6 is a partial top view of FIG. 1.

Referring to FIG. 6 specifically, flexible strip 43 is oblique at a predetermined angle with respect to planar portion 410. Such angle is the designed maximum angle of right arm 30*b* outward flexing with respect to body 11 when installing RAM module 40. One end of flexible strip 43 is connected with planar portion 410 at a position abutted the joint 31 of right arm 30*b*, while a portion near the other end of flexible strip 43 is connected with engagement member 42 fixed on mainboard 20. As such, with the support of engagement member 42, flexible strip 43 can share the stress with plate member 41 and right arm 30*b* when right arm 30*b* flexs outward or inward during the process of installing RAM module 40. This can prevent stress from concentrating on joint 31. Otherwise, joint 31 may be broken or damaged.

Figure 7A:
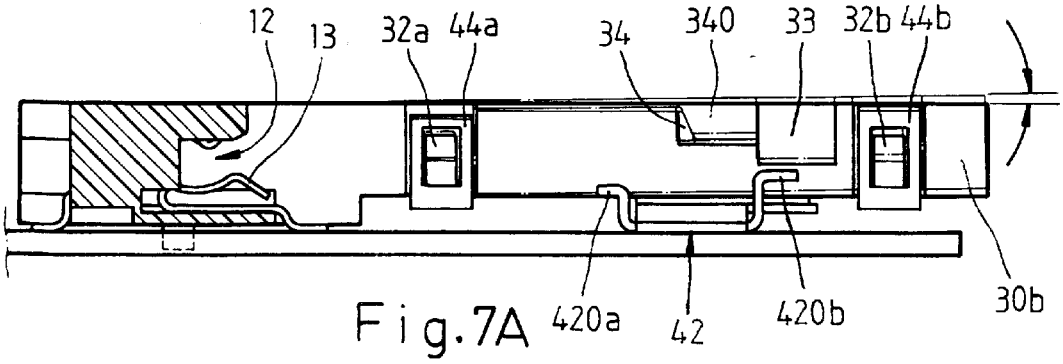
FIG. 7A is similar to FIG. 5 where RAM module removed to illustrate the allowance of tab member with respect to raised member of arm.
Figure 7B:
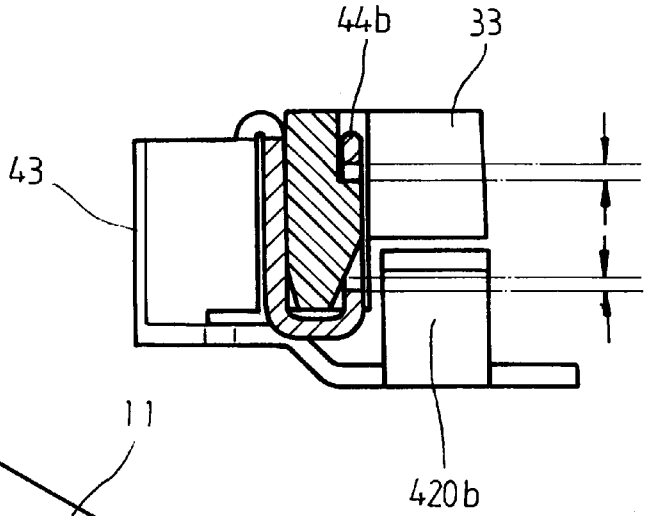
FIG. 7B is a sectional view of arm illustrating the allowance of tab member with respect to raised member of arm.
Figure 4:
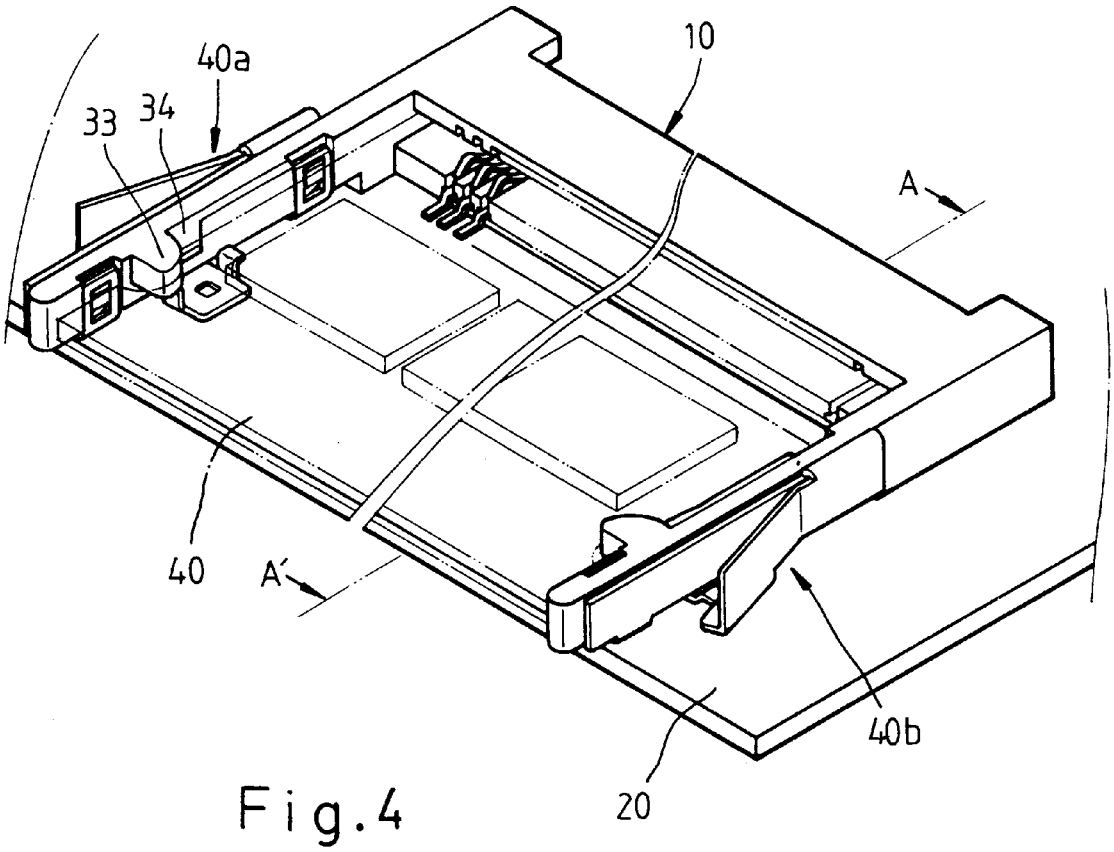
FIG. 4 is a perspective view showing mounted RAM module secured by connector and enhancement device.
Figure 5:
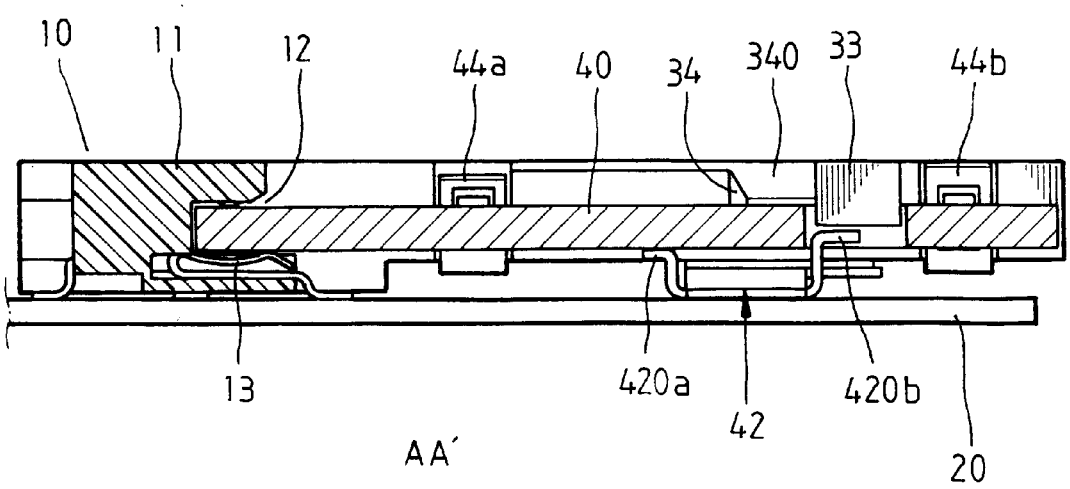
FIG. 5 is sectional view taken along line A—A of FIG. 4 showing the engagement of RAM module, connector, and enhancement device.
Figure 8:
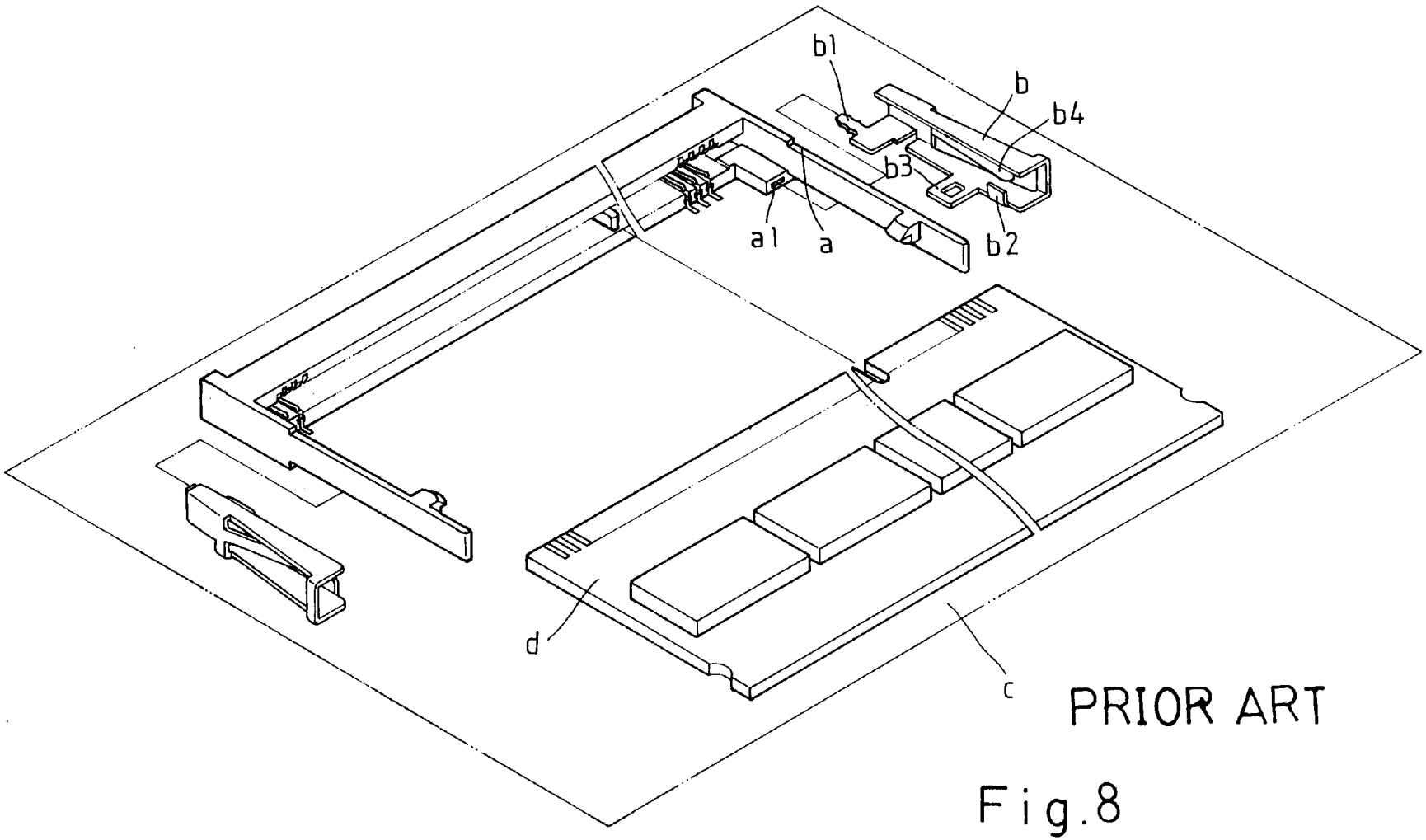
PRIOR ART Fig.8
FIG. 8 is a perspective view showing the conventional connector and enhancement device.

Referring to FIG. 2 again, two side wings 420*a* and 420*b* are provided on engagement member 42 wherein side wing 420*a* can support mounted RAM module 40 (see FIG. 5 specifically) and side wing 420*b* urges against the bottom of positioning projection 33 to share the force exerted on right arm 30*b* (see FIGS. 4 and 3B). Note that raised members 32*a* and 32*b* of arms 30*a* and 30*b* may have tolerances exceeding predetermined ranges in the manufacturing process due to the nature of plastic. As such, it is desirable that the central openings of tab members 44*a* and 44*b* are suitably larger than the sizes of raised members 32*a* and 32*b* so as to fit tab members 44*a* and 44*b* onto raised members 32*a* and 32*b* (see FIGS. 7A and 7B).

While the invention herein disclosed has been described by means of specific embodiments, numerous modifications and variations could be made thereto by those skilled in the art without departing from the scope and spirit of the invention set forth in the claims.

What is claimed is:

1. A connector assembly in a computer comprising:

a plastic connector mounted on a mainboard of the computer including a body, a slot, a plurality of contact electrodes in the slot, and two parallel arms each having a positioning projection and a protrusion with a guide slope defined between a top side of the arm and the protrusion; and an enhancement device secured to each of the arms, each enhancement device including a plate member, a protruded engagement member fixed on the mainboard, and a flexible strip that slants away from the arm to which the flexible strip is secured, a first end of the flexible strip is connected to the plate member at a position abutting a joint element that connects the arm and the body of the connector, and a second end of the flexible strip is connected to the engagement member;

wherein with the support of the engagement members, the flexible strips can share stress with the plate members and the arms when inserting a random access memory module in the connector.

2. The connector assembly of claim 1, wherein the length of the plate member is conformed to that of the arm.

3. The connector assembly of claim 1, wherein the enhancement device is made of metal.

4. The connector assembly of claim 1, wherein the engagement member is fixed on the mainboard by soldering.

5. The connector assembly of claim 1, wherein the engagement member comprises two side wings, one side wing supports the mounted random access memory module and the other side wing urges against the bottom of the positioning projection to share the force exerted on the arm.

6. The connector assembly of claim 1, wherein the plate member has a U-shaped cross section comprising a planar portion engaged with the arm and a plurality of spaced tab members engaged with the raised members.

7. The connector assembly of claim 6, wherein the flexible strip is positioned at an angle with respect to the planar portion of the plate member to define a flex limit of the arm with respect to the body of the connector.

8. The connector assembly of claim 6, wherein the tab member comprises an opening larger than the raised member so that the tab member fits onto the raised member.

9. A connector assembly in a computer comprising:

a plastic connector mounted on a mainboard of the computer including a body, a slot, a plurality of contact electrodes in the slot, and two parallel arms each having a positioning projection and a protrusion with a guide slope defined between a top side of the arm and the protrusion; and an enhancement device secured to each of the arms, each enhancement device including a plate member, a protruded engagement member fixed on the mainboard, and a flexible strip that slants away from the arm to which the flexible strip is secured;

wherein the engagement member comprises two side wings, one side wing supports the mounted random access memory module and the other side wing urges against the bottom of the positioning projection to share the force exerted on the arm, and with the support of the engagement members, the flexible strips can share stress with the plate members and the arms when inserting a random access memory module in the connector.

10. The connector assembly of claim 9, wherein the length of the plate member is conformed to that of the arm.

11. The connector assembly of claim 9, wherein one end of the flexible strip is connected with the plate member at a position abutted the joint of the arm and the body of the connector and the other end of the flexible strip is connected with the engagement member.

12. The connector assembly of claim 9, wherein the enhancement device is made of metal.

13. The connector assembly of claim 9, wherein the engagement member is fixed on the mainboard by soldering.

14. The connector assembly of claim 9, wherein the plate member has a U-shaped cross section comprising a planar portion engaged with the arm and a plurality of spaced tab members engaged with the raised members.

15. The connector assembly of claim 14, wherein the flexible strip is oblique at a predetermined maximum angle with respect to the planar portion of the plate member for defining the arm to flex therein with respect to the body of the connector.

16. The connector assembly of claim 14, wherein one end of the flexible strip is connected with the planar portion of the plate member at a position abutted the joint of the arm and the body of the connector and the other end of the flexible strip is connected with the engagement member.

17. The connector assembly of claim 14, wherein the tab member comprises an opening larger than the raised member so that the tab member fits onto the raised member.

* * * * *